US006691893B2

(12) United States Patent
Gauthier

(10) Patent No.: US 6,691,893 B2
(45) Date of Patent: Feb. 17, 2004

(54) REPLACEABLE RESERVOIR FOR LIQUID DISPENSER

(75) Inventor: Jerome M. Gauthier, Roselle, IL (US)

(73) Assignee: Sloan Valve Company, Franklin Park, IL (US)

( * ) Notice: Subject to any disclaimer, the term of this patent is extended or adjusted under 35 U.S.C. 154(b) by 209 days.

(21) Appl. No.: 09/834,447

(22) Filed: Apr. 13, 2001

(65) Prior Publication Data

US 2002/0148853 A1 Oct. 17, 2002

(51) Int. Cl.[7] ..... B65D 35/28
(52) U.S. Cl. ..... 222/95; 222/389; 222/401
(58) Field of Search ..... 222/95, 105, 386.5, 222/389, 399, 400.7, 401

(56) References Cited

U.S. PATENT DOCUMENTS

| | | | | | |
|---|---|---|---|---|---|
| 2,387,598 | A | | 10/1945 | Mercier | |
| 2,668,637 | A | | 2/1954 | Gilmore | |
| 3,677,444 | A | | 7/1972 | Merrill | |
| 4,030,640 | A | | 6/1977 | Citrin et al. | |
| 4,147,278 | A | * | 4/1979 | Uhlig | 222/95 |
| 4,484,697 | A | | 11/1984 | Fry, Jr. | |
| 4,854,482 | A | | 8/1989 | Bergner | |
| 5,033,656 | A | | 7/1991 | Blette et al. | |
| 5,035,350 | A | | 7/1991 | Blette et al. | |
| 5,115,945 | A | | 5/1992 | Ruck | |
| 5,174,343 | A | * | 12/1992 | Rood | 222/399 |
| 5,199,609 | A | * | 4/1993 | Ash, Jr. | 222/105 |
| 5,248,064 | A | * | 9/1993 | Claycomb, Jr. | 222/95 |
| 5,248,066 | A | | 9/1993 | Olson et al. | |
| 5,251,787 | A | * | 10/1993 | Simson | 222/95 |
| 5,429,681 | A | | 7/1995 | Mesenbring | |
| 5,497,912 | A | * | 3/1996 | Hoback et al. | 222/95 |
| 5,526,957 | A | * | 6/1996 | Brown et al. | 222/105 |
| 5,529,220 | A | * | 6/1996 | Credle et al. | 222/399 |
| 5,566,863 | A | | 10/1996 | Mesenbring et al. | |
| 5,607,082 | A | * | 3/1997 | Cracauer | 222/95 |
| 5,772,075 | A | * | 6/1998 | Ash et al. | 222/399 |
| 5,806,717 | A | | 9/1998 | De Rosenzeig-Page | |
| 5,810,204 | A | | 9/1998 | Devlin et al. | |
| 6,015,068 | A | * | 1/2000 | Osgar et al. | 222/95 |
| 6,062,425 | A | | 5/2000 | Brown et al. | |
| 6,082,589 | A | * | 7/2000 | Ash et al. | 222/399 |

* cited by examiner

*Primary Examiner*—Kenneth Bomberg
(74) *Attorney, Agent, or Firm*—Cook, Alex, McFarron, Manzo, Cummings & Mehler, Ltd.

(57) ABSTRACT

A liquid soap reservoir in which the liquid soap is expelled from the reservoir due to pressure exerted on its contents by a second, low viscosity pressurized fluid, with the associated pumping mechanism being removed from the soap path and acting only on the second fluid. The reservoir comprises a first closed container having an inlet in fluid communication with the pumping mechanism for selectively admitting the second fluid into the first container. A second collapsible closed container is disposed within the first container for containing the liquid soap and has an outlet in fluid communication with the outlet of the dispenser. Accordingly, when the second fluid, under pressure from the pump, is admitted into the first container, pressure is exerted on the second container to partially collapse the second container and expel a quantity of the liquid soap from the second container out through the outlet of the dispenser.

16 Claims, 2 Drawing Sheets

Fig. 1.
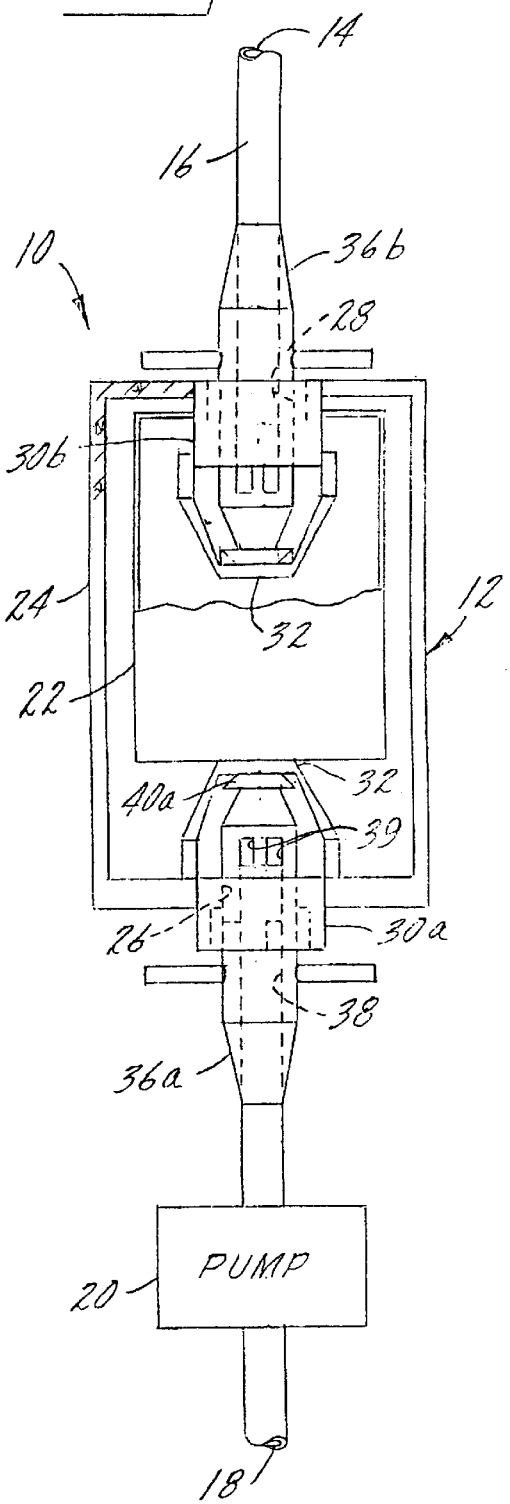
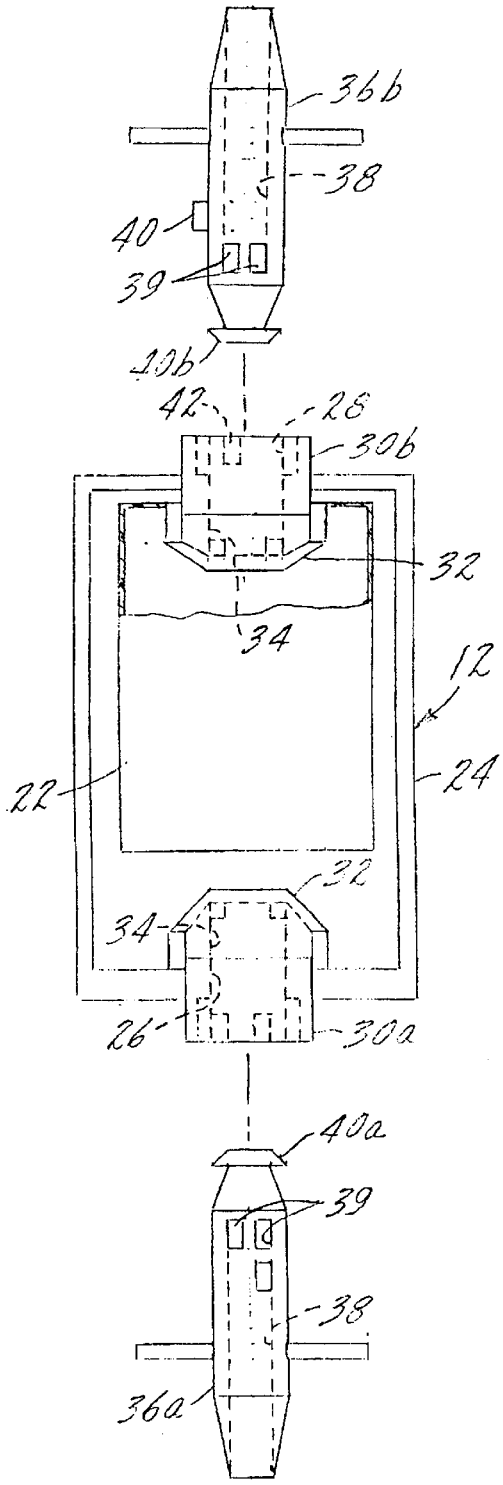
Fig. 2.

REPLACEABLE RESERVOIR FOR LIQUID DISPENSER

BACKGROUND OF THE INVENTION

The present invention relates to a liquid dispensing system and, more particularly, to a replaceable reservoir for use in a soap dispenser.

Liquid soap dispensers are ubiquitous in the restrooms of public accommodations, as well as in business and industrial settings. The advantages of liquid soap dispensers over bar soap are readily apparent. There is no wet, slimy bar of soap that others have handled (and possibly contaminated) and that needs to be replaced in an adjacent soap dish after use. Liquid soap dispensers provide each user with an individualized portion of soap from a conveniently-located source.

However, most liquid soap dispensers use a pump mechanism that is in the flow path of the soap as it is dispensed. This can present at least two different problems. First, the highly viscous nature of the liquid soap makes it difficult to pump. Second, the pumping mechanism may become clogged by the soap, particularly if the soap dries out. Replacement of a clogged pump mechanism is likely to be cost prohibitive in most situations and, in all likelihood, the entire dispenser would be replaced if the pump were clogged.

Accordingly, it is a principal object of the present invention to provide a liquid soap dispenser in which the pumping mechanism is isolated from the soap flow path.

More particularly, it is an object of the present invention to provide a replaceable liquid soap reservoir for use in a dispenser in which the pumping mechanism is separate from the soap flow path.

It is a further object of the invention to provide a soap reservoir in which the likelihood of contamination of the contents is reduced.

SUMMARY OF THE INVENTION

These objects, as well as others that will become apparent upon reference to the following detailed description and accompanying drawings, are achieved by a liquid soap reservoir in which the liquid soap is expelled from the reservoir due to pressure exerted on its contents by a second, low viscosity pressurized fluid, with the associated pumping mechanism being removed from the soap path and acting only on the second fluid. The reservoir comprises a first closed container having an inlet in fluid communication with the pumping mechanism for selectively admitting the second fluid into the first container. A second collapsible closed container is disposed within the first container for containing the liquid soap and has an outlet in fluid communication with the outlet of the dispenser. Accordingly, when the second fluid, under pressure from the pump, is admitted into the first container, pressure is exerted on the second container to partially collapse the second container and expel a quantity of the liquid soap from the second container out through the outlet of the dispenser.

The reservoir may be provided with a pair of connectors, one at the inlet of the first container and the other at the outlet of the second container, with each connector including a seal that is normally closed and is adapted to receive a mating connector from one of the pump and dispenser outlet. Accordingly, when the reservoir is installed in the dispenser and the connectors are connected to their mating connector, the seals are opened to permit the selective introduction of the second fluid into the first container and the expulsion of the liquid soap out of the second container.

While the invention is described in terms of a liquid soap dispenser, it may also be utilized to dispense other highly viscous liquids, such as hand lotions or condiments like ketchup and mustard. The reservoir may also be used in connection with other, less viscous liquids intended for human consumption, i.e., beverages, where reduced likelihood of contamination is desired.

BRIEF DESCRIPTION OF THE DRAWINGS

FIG. 1 is a schematic diagram of a liquid dispensing system incorporating a replaceable reservoir in accordance with the present invention.

FIG. 2 is an exploded view of the reservoir and its associated connectors.

DETAILED DESCRIPTION OF THE PREFERRED EMBODIMENTS

Figure 3:
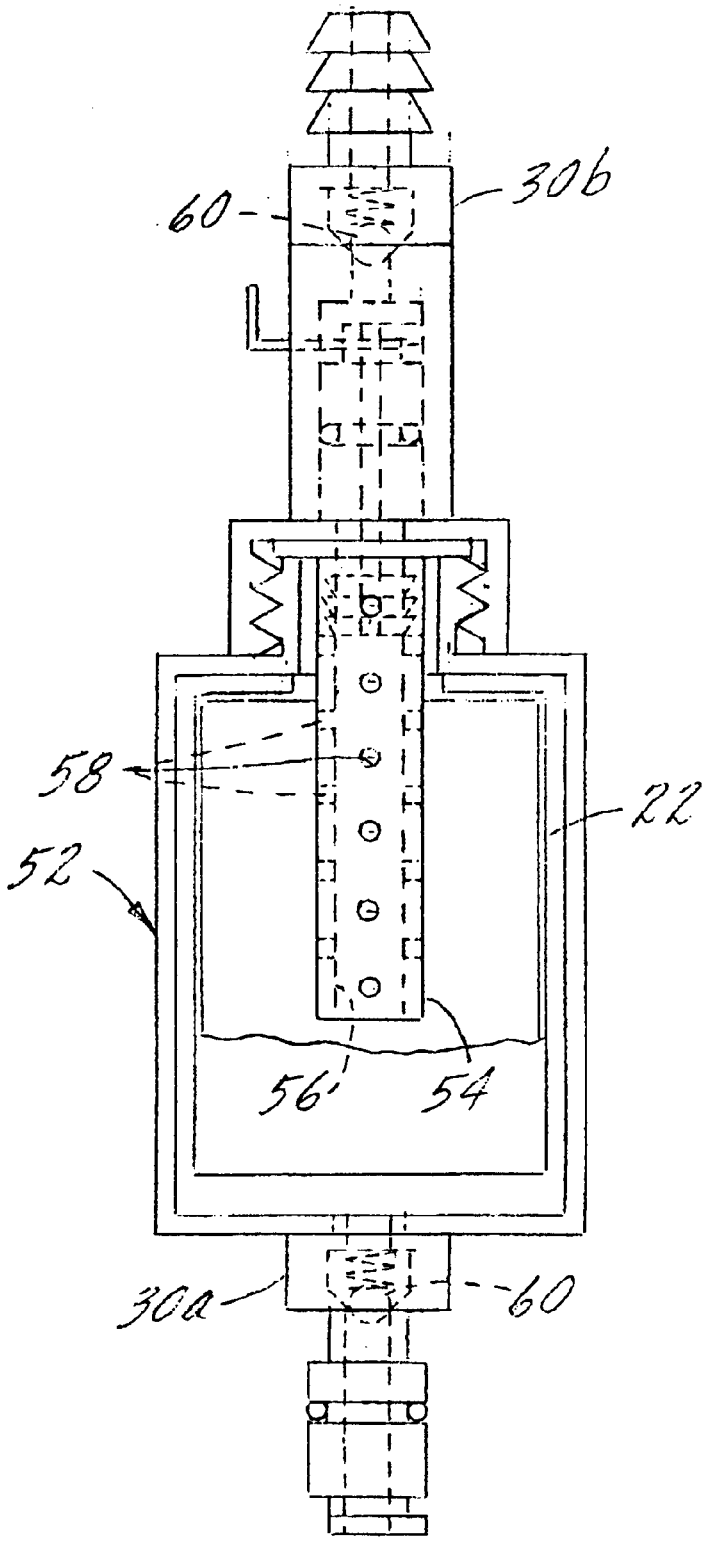
FIG. 3 is a schematic view of an alternate embodiment of the reservoir and associated connectors.

Turning to the drawings, there is seen in FIG. 1 a schematic representation of a soap dispenser, generally indicated 10, according to the present invention. The dispenser 10 includes a liquid soap reservoir 12 that is in fluid communication with an outlet 14 for the dispenser through a soap path 16. The dispenser 10 also includes a water inlet 18 that is in fluid communication with a pump 20.

The pump may take any number of well-known forms, and is preferably an electrically-powered pump which is "hands free" activated for a predetermined period of time through, e.g., an infrared sensor that detects the presence of an object underneath the soap outlet. As will become clear, the introduction of a predetermined volume of water into the reservoir 12 results in an approximately equal volume of liquid soap being expelled out of the reservoir and through the outlet of the dispenser. Importantly, the liquid soap is expelled from the dispenser 10 without having passed through the pump 20.

In keeping with the invention, the reservoir 12 comprises two containers 22, 24, with one container 22 being disposed on the interior of the other container 24. The exterior container 24 is initially empty except for holding the interior container (and its contents), and is sealed except for an inlet 26 which allows the introduction of pressurized water into the exterior container 24. The interior container 22 is initially filled with liquid soap and is sealed except for an outlet 28 that extends through, and is sealed with respect to, the exterior container 24.

The interior container 22 is typically a plastic bag which is readily collapsible, while the exterior container 24 may also be a plastic bag or may be a plastic bottle. In any event, the exterior container 24 should be of a material or a construction that does not expand beyond a fixed volume when the pressurized water is introduced. Otherwise, the exterior container 24 might expand to accommodate the introduction of pressurized water, rather than compress and collapse the interior container 22 to expel the liquid soap upon the introduction of water into the exterior 24.

By this construction, the volume of soap dispensed is approximately the same as the volume of water introduced into the exterior container 24. Thus the volume of soap dispensed can be controlled through the pump 20, most likely by limiting the duration of time the pump 20 is run each time it is actuated. It is contemplated that this would be subject to electronic controls of a generally known type.

In keeping with another aspect of the invention, the inlet 26 of the exterior container 24 and the outlet 28 of the interior container 22 are provided with connectors 30*a*, 30*b* respectively, which seal the containers from the atmosphere until such time as the reservoir is installed in the dispenser 10. In the embodiment of FIGS. 1 and 2, this is accomplished by providing the connectors with an elastic cap 32 that overlies and seals the interior openings 34 of each connector 30*a*, 30*b* (best seen in FIG. 2). The elastic caps 32 are moved away from the openings 34 of the connectors 30*a*, 30*b* during the installation of the reservoir 12 and the dispenser 10.

Each connector 30*a*, 30*b* is adapted to receive a mating connector 36*a*, 36*b* respectively. These connectors 36*a*, 36*b* are attached to the fluid passageways in the dispenser 10 through which the pressurized water is introduced into the reservoir (i.e., connector 36*a*) and the soap is expelled (i.e., connector 36*b*). As illustrated in FIGS. 1 and 2, the mating connectors 36*a*, 36*b* are elongated, plunger-type fittings having a central passageway 38 with exit ports 39, thus permitting communication between the central passageway and the interior of the respective containers.

Each connector 36*a*, 36*b* includes an end portion 40*a*, 40*b*, respectively, designed to push the elastic cap 32 away from the interior opening 34 of the respective connector 30*a*, 30*b*. This occurs upon the insertion of the connectors 36*a*, 36*b* into the connectors 30*a*, 30*b*, thus providing fluid access through the interiors of both the interior and exterior container 22, 24. Importantly, the elastic caps 32 close the openings 34 when the connectors 36*a*, 36*b* are disconnected, thus preventing leakage when the reservoir is removed during replacement.

In keeping with another aspect of the invention, the mating connectors 30*a*, 36*a* and 30*b*, 36*b* may be configured so that they cannot be mistakenly attached to the wrong connector. To this end, at least one pair of mating connectors is provided with a key and keyway. As best seen in FIG. 2, connector 36*b* is provided with a key 40 that is received in a keyway 42 in the connector 30*b*. This permits the connector 36*b* to be received only in connector 30*b*, and not connector 30*a*. Preferably, connectors 30*a* and 36*a* also have mating a key and keyway, but in a different configuration than that of connectors 30*b* and 36*b*, thus providing more certain protection against mistaken connections.

Turning to FIG. 3, there is seen an alternate embodiment of a fluid reservoir 52 according to the present invention. There are at least two notable differences between the configuration of the reservoir 12 of FIGS. 1 and 2 and that of the reservoir 52 of FIG. 3. Importantly, the soap bag connector 30*b* in reservoir 52 includes a feed tube 54 that extends into the interior of the soap bag 22. The tube 54 includes a central passageway 56 that extends therethrough and a series of holes or perforations 58 along its length to provide fluid access between the exterior of the tube 54 and the passageway 56. The multiple openings 58 in the feed tube 54 prevent the outlet of the interior bag 22 from clogging as the bag collapses due to the dispensing of its contents.

Further, the reservoir 52 includes a ball and spring check valve 60 in each of its connectors 30*a* and 30*b*, the ball being biased by the spring into a normally closed condition. These check valves 60 prevent any backflow from the reservoir and open only upon the activation of the pump to introduce pressurized water into the dispenser and to expel liquid soap from the reservoir.

Thus, a replaceable reservoir for a liquid soap dispenser has been provided that meets all the objects of the present invention. While the invention has been described in terms of certain preferred embodiments, it should be realized that there may be many modifications, substitutions and alterations thereto. Thus, there is no intent to limit the invention to the disclosed embodiments. Instead, it is intended to be described by the scope of the appended claims.

What is claimed is:

1. In a liquid dispenser for dispensing a first fluid, the dispenser including an outlet for the first fluid, an inlet for a second fluid, and a pump for pressurizing the second fluid, a replaceable reservoir for the first fluid comprising:

a first closed container having an inlet in fluid communication with the pump for selectively admitting the second fluid into the first container;

a second collapsible closed container disposed within the first container for containing the first fluid and having an outlet in fluid communication with the outlet of the dispenser; and the inlet of the first container and the outlet of the second container each comprising a connector including a seal that is normally closed, each connector being adapted to receive a mating connector from one of the pump and dispenser outlet, at least one of the connectors and its mating connector including a keyed fitting so that each connector will connect only with its intended mate so that, when the reservoir is installed in the dispenser and the connectors are connected to their mating connector, the seals are opened to permit the selective introduction of the second fluid into the first container and the expulsion of the first fluid out of the second container.

2. The reservoir of claim 1 wherein the first container comprises a plastic bottle and the second container comprises a plastic bag.

3. The reservoir of claim 1 wherein the seal comprises a check valve.

4. The reservoir of claim 3 wherein the check valve comprises a ball biased by a spring into a normally closed condition.

5. The reservoir of claim 1 wherein both the first container and second container comprise collapsible plastic bags.

6. The reservoir of claim 1 wherein both pairs of mating connectors have keyed fittings.

7. The reservoir of claim 1 wherein the connector comprising the outlet of the second container includes an elongated fluid supply tube extending into the interior of the second collapsible container.

8. The reservoir of claim 7 wherein the supply tube includes a plurality of spaced-apart holes along its length.

9. In a liquid soap dispenser, the dispenser including an outlet for the liquid soap, an inlet for a second fluid, and a pump for pressurizing the second fluid, a replaceable reservoir for the liquid soap comprising:

a first closed container having an inlet in fluid communication with the pump for selectively admitting the second fluid into the first container;

a second collapsible closed container disposed within the first container for containing the liquid soap and having an outlet in fluid communication with the outlet of the dispenser; and the inlet of the first container and the outlet of the second container each comprising a connector including a seal that is normally closed, each connector being adapted to receive a mating connector from one of the pump and dispenser outlet, at least one of the connectors and its mating connector including a keyed fining so that each connector will connect only with its intended mate, so that, when the reservoir is installed in the dispenser and the connectors are connected to their mating connector, the seals are opened to permit the selective introduction of the second fluid into the first container and the expulsion of the liquid soap out of the second container;

whereby when the second fluid under pressure from the pump is admitted into the first container, pressure is exerted on the second container to partially collapse the second container and expel a quantity of the liquid soap from the second container out through the outlet of the dispenser.

10. The reservoir of claim 9 wherein the seal comprises a check valve.

11. The reservoir of claim 10 wherein the check valve comprises a ball biased by a spring into a normally closed condition.

12. The reservoir of claim 9 wherein both pairs of mating connectors have keyed fittings.

13. The reservoir of claim 9 wherein the connector comprising the outlet of the second container includes an elongated fluid supply tube extending into the interior of the second collapsible container.

14. The reservoir of claim 13 wherein the supply tube includes a plurality of spaced-apart holes along its length.

15. The reservoir of claim 9 wherein the first container comprises a plastic bottle and the second container comprises a plastic bag.

16. The reservoir of claim 9 wherein both the first container and second container comprise collapsible plastic bags.

* * * * *